US006227914B1

(12) United States Patent
Lee et al.

(10) Patent No.: US 6,227,914 B1
(45) Date of Patent: May 8, 2001

(54) POWER DISTRIBUTION BLOCK ASSEMBLY FOR ACCOMMODATING MULTIPLE GAUGE WIRES

(75) Inventors: Kendrew Lee, San Jose; Demian Martin, Pacifica, both of CA (US)

(73) Assignee: Monster Cable Products, Inc., Brisbane, CA (US)

( * ) Notice: Subject to any disclaimer, the term of this patent is extended or adjusted under 35 U.S.C. 154(b) by 0 days.

(21) Appl. No.: 09/327,047

(22) Filed: Jun. 7, 1999

(51) Int. Cl.[7] ..... H01R 4/28

(52) U.S. Cl. ..... 439/754; 439/766; 439/805; 439/957

(58) Field of Search ..... 439/754, 724, 439/798, 431, 416, 766

(56) References Cited

U.S. PATENT DOCUMENTS

| | | | | |
|---|---|---|---|---|
| 4,380,291 | * | 4/1983 | Shannon | 439/754 |
| 4,405,196 | * | 9/1983 | Fulton | 439/754 |
| 4,747,793 | * | 5/1988 | Fakula et al. | 439/766 |
| 5,266,057 | | 11/1993 | Angel, Jr. et al. . | |

* cited by examiner

*Primary Examiner*—Neil Abrams
*Assistant Examiner*—J. F. Duverne

(74) *Attorney, Agent, or Firm*—Lariviere, Grubman & Payne, LLP

(57) ABSTRACT

A solid brass battery connector block assembly for providing power distribution from a power source, such as a vehicle battery, to attached wire conductors. The assembly includes a conductive base unit 100 which connects to a battery via a battery clamp portion 400. The battery clamp portion 402 is mounted in an opening 112 in the base unit 100 that extends from the top surface to the bottom surface thereof. The base unit 100 is essentially fan shaped and is molded with extended portions emanating from the vertex of the fan shape. At the ends of the extended portions are molded or machined holes 106, 108, 110 extending into the body of the base unit 100. Master rings 202, 204, 206 and collet assemblies 208, 220, 230, or 240 are screw mounted in the holes 106, 108, 110 in the extended portions, the collets 208, 220, 230, or 240 having varying central bore holes to accommodate various gauge size wire conductors. A master nut 300 is mounted on the base unit 100 from the top thereof onto the battery clamp portion 402 extending up through the opening from the bottom of the base unit 100. As the master nut 300 is tightened on the battery clamp portion 402, the battery clamp 400 is tightened against the terminal of the vehicle battery and also the inside of the opening 112 in the base unit 100 to provide an excellent conductive path for the electric current to flow from the battery to the wire conductors. A charging post 500 is also provided to attach in a screw relationship to the battery clamp portion 404 in the event the battery needs external charging

20 Claims, 6 Drawing Sheets

1 GUAGE COLLET

2 GUAGE COLLET

4 GUAGE COLLET

8 GUAGE COLLET

POWER DISTRIBUTION BLOCK ASSEMBLY FOR ACCOMMODATING MULTIPLE GAUGE WIRES

TECHNICAL FIELD

The present invention relates to power distribution devices and more particularly to vehicle battery power distribution devices used in vehicle high fidelity sound systems with components of varying power necessities.

BACKGROUND OF THE INVENTION

Sound systems in present day automotive vehicles are important options in the minds of vehicle owners. Before some buyers will purchase an automobile or other vehicle, they will investigate whether the sound system is modem and can produce the sound fidelity at a level acceptable to the purchaser. In many instances the sound system for a vehicle may include an AM/FM stereo radio, a cassette tape player, a CD player, along with high fidelity electronics and multiple speakers within the vehicle. While most sound and radio systems that accompany new cars are adequate for most purchasers, certain discriminating buyers desire a higher fidelity system including larger amplifiers to drive the bigger speakers necessary to accommodate the improved sound system desired. Many purchasers of third party sound systems for vehicles desire bigger and more powerful amplifiers and speakers so that the sound and fidelity level is higher than can be accomplished by the systems from the vehicle manufacturer and add an improved fidelity level. Bigger speakers and amplifiers of necessity will draw more power from the electrical system in the vehicle.

The wiring in an automobile or other vehicle is usually designed for normal current distribution for the sound system that accompanies a new vehicle from the factory. However, when larger amplifiers and speakers are desired and purchased for installation in the vehicle, many times the electrical power system must be upgraded so that the sound system will receive the electric current necessary to produce the sound at the increased level. Larger gauge wire is sometimes necessary to conduct the required current from the battery and generator in the vehicle to the electronics and speakers which comprise this upgraded sound system. In addition, certain vehicles may need increased generator and battery power if the sound system installed utilizes too much current and power from the existing vehicle supply.

In order to bypass the installed wiring in the vehicle, it is sometimes desirable to connect power wiring directly to the battery of the vehicle so as not to overload the existing wiring in the vehicle. The wiring, therefore, of the new power cable or cables to the battery is important so that good contact can be made with the battery terminal post, as well as having the power cable include a wire gauge sufficient to carry the necessary current for the installed sound system. U.S. Pat. No. 5,266,057, issued Nov. 30, 1993, assigned to the same assignee as the present application, and herein incorporated by reference, discloses a similar electronic power distributor as set forth in this application. The patent discloses a power distribution device, which is primarily designed for mounting on a vehicle battery, but which may be used in other applications where multiple gauges of wire are desired for distributing power. These other application would have mechanical interfaces which adapt to structure of the present invention. In the preferred embodiment the device of the present invention is shaped as a bilaterally truncated cylinder, like a hockey puck, and preferably constructed of brass. On the top surface of the patented electronic power distributor, there are a number of holes which extend into the base unit. These holes have a threaded portion for engaging with a power bolt. The side circular surface contains a number of holes which extend into the base unit and are positioned to perpendicularly intersect the holes which extend from the top surface. The holes on the side are capable of receiving strands of wire conductor or an adapter of other size conductors. The power puck of the patent contains a clear encasing to protect it from the outside environment. It would be desirable, however, to provide a more modem, improved operational battery connector block.

BRIEF SUMMARY OF THE INVENTION

According to the present invention, an electrical connector block assembly is disclosed for distributing electric power from a power source, such as a vehicle battery to attached wire conductors of possible varying size gauge wires. The assembly includes a conductive base unit having a top and bottom surface and having a first opening in said base unit which extends through to the bottom surface, where the base unit is essentially fan shaped with extended portions radiating from the vertex of the base unit. A battery clamp portion is positioned in said conductive base unit in the first opening in said base unit where the battery clamp portion is positioned from the bottom surface of said base unit and extends out past the top surface of said base unit. A master ring assembly attaches to at least one of the extended portions of the base unit, where the master ring assembly is utilized to attach a wire conductor to the base unit. A master nut is provided for attachment to the portion of the battery clamp extending into the lower portion of said conductive base unit to maximize the contact of said battery clamp to the base unit. The battery clamp comprises a first portion including a tubular portion extending longitudinally from the middle of the length of the battery clamp and comprises an inner diameter which increasingly expands to an outer diameter along the axis of said battery clamp to accommodate the tapered post of a vehicle battery. The battery clamp also includes a second portion which extends longitudinally along the longitudinal axis of the battery clamp and includes inner threads which extend from the upper end partially into the upper portion of said battery clamp, and an outer threaded portion along the outer surface of said battery.

A master ring assembly comprises a tubular circular head member with a first portion having a first external diameter and a second portion with a second external diameter, where the second portion has an external threaded portion and includes a longitudinal axial opening through the master ring of a predetermined diameter, where the circular tubular member is adapted for manual or physical tightening movements thereon. Further, the master ring assembly includes a collet member which comprises a circular tubular portion with at least a first and second outer diameters wherein the first diameter is approximately the same as the diameter of the longitudinal axial opening in the master ring, the second diameter of a dimension to be positioned within one of said extended portions of said conductive base. The collet portion includes a longitudinal opening along the axis thereof to match that of a conductive wire cable to be connected to said electrical connector block assembly. The master nut comprises a tubular portion of the first diameter and a longitudinal axial opening defining said tubular portion where the tubular portion includes inner threads which extended least partially through said longitudinal axial opening.

BRIEF DESCRIPTION OF THE DRAWINGS

For a more complete understanding of the invention, reference may be had to the following detailed description of the invention in conjunction with the drawings wherein.

DETAILED DESCRIPTION OF THE INVENTION

Figure 1:
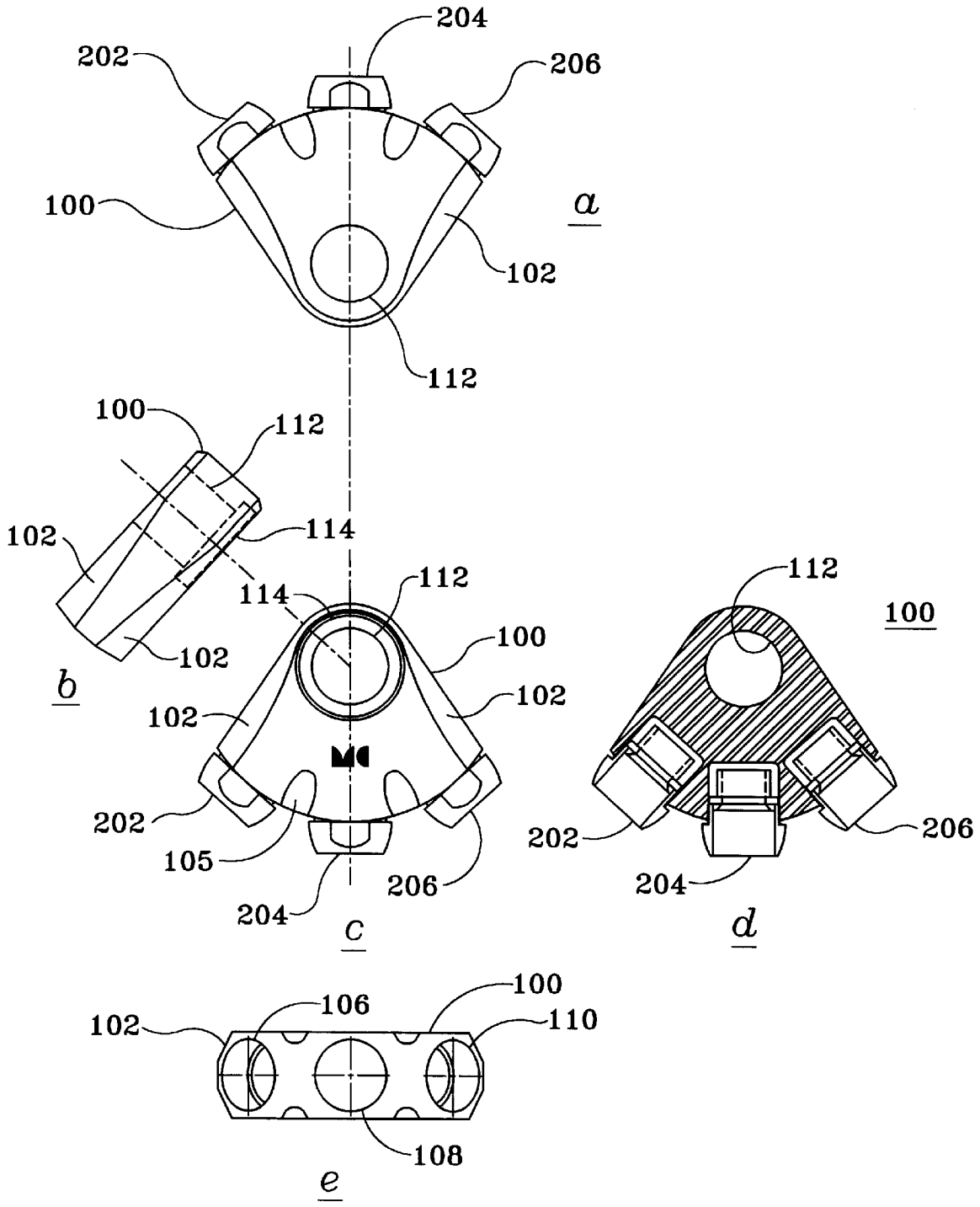
FIG. 1A through FIG. 1E illustrate the bottom, side, top, section, and front views, respectively, of the battery terminal block of the present invention.

This invention relates to power distribution apparatus. More particularly, this invention relates to a competition battery terminal for improving the performance connection of after-market power amplifiers connected to a vehicle battery. While only the vehicle battery is discussed as the power source in describing the invention, it is understood that other power sources may be adapted to interface with the mechanical structure of the present invention. Accordingly, the high current power distribution capability the power distribution block of the present invention offers, and provides efficient, instantaneous transfer of power for the best amplifier performance and thus the best sound output. This battery terminal block is engineered to ensure greater DC current transfer between a vehicle battery and the power cable than in prior art devices. The disclosed battery terminal block features proprietary designs. Most vehicle lead battery posts are tapered; however, until now, no battery terminal has featured a tapered design to maximize the most secure, no slip fit. The tapered terminal block herein attaches to the vehicle battery, completely encasing the lead post, thereby eliminating both slippage and corrosion. The superior connection results in better power transfer and reduced resistance to electric power flow. The revolutionary design of the battery terminal block of the present invention eliminates the need for hand tools for tightening and also provides for quick release. The battery block also protects users from electric shock caused by the battery posts. Three screw out rings which house the power cables are universally threaded, allowing any gauge power cable to be fastened. A molded, transparent polycarbonate casing covers the top half of the battery connector block, secured to the block with a heavy duty prong. The casing protects the overall unit.

If a user needs a different gauge power cable, a whole new battery terminal is not necessary, only an appropriately sized nut and accompanying collet to accommodate the different sized cable is necessary.

The battery connector block is made of solid brass with 24 karat gold plating for corrosion protection as well as improved electrical connection. The fanned, design is an improvement over the prior art machined, uniform look of prior art common rectangular-shaped battery terminals. The sides of the terminal are scooped inwardly, however, not uniformly, giving the connector block a thinner, sleeker look. The connector block's triangular design acts as a visual metaphor of the flow of DC current as it starts at the vehicle battery and gracefully fans out to the various power cables connected. The slightly recessed cloverleaf design which outlines the top surface of the terminal is intended to visually accentuate the cable distribution.

The solid brass construction of the terminal delivers very high conductivity, while lending a visual presence that symbolizes elegance and durability. A particular feature of the invention regards the design of the clamping feature to provide the maximum clamping pressure to the battery post without the use of other hand tools. The connector block design provides for greater reliability and a higher performance for the discriminating purchaser of vehicle sound systems. The various aspects of the battery connector block includes its design for maximum compatibility, increased power transfer, and greater system design flexibility than prior art clamps.

FIG. 1A through FIG. 1E illustrate the bottom, side, top, section, and front views of the battery connector block in accordance with the principles of the present invention. FIG. 1C illustrates the fanned and pseudo cloverleaf design of the battery terminal. Block 100 is the gold plated brass block which has been either machined or molded into the cloverleaf shape of the block. At the apex of the fanned shape is a hole 112 which is used to position the terminal over and around the battery post. A recessed hole 114 with a larger diameter than hole 112 provides a rest indent for master nut 300 which provides the compression strength necessary to affix the terminal block to the post of the battery. The terminal block 100 fans out to the three leaves to provide connection for three power cables. Shown in FIG. 1 are master rings 202, 204, 206 which will, by the threaded portions, connect the power cables to the terminal block 100. Tapered portions 102 and recessed portions 105 provide a visual, graceful and futuristic look to the terminal block although they add no functional capability thereto.

FIG. 1B is a side view in a perpendicular direction directly from one side of block 100. Seen in FIG. 1B are the tapered portions 102, as well as the placement of the hole 112, which extends all the way through the terminal block 100, and the recessed hole 114, concentric with hole 112, which extends only part way through the terminal block and has a larger diameter than hole 112. FIG. 1A is a bottom view of the terminal block 100 and shows the master rings 202, 204, 206, and the tapered portions 102. Also seen in FIG. 1A is the hole 112 which, as set forth above, extends all the way through the terminal block from the top surface to the bottom surface. As hole 114 does not extend through block 100, it is not seen in FIG. 1A.

FIG. 1D is a section view of the terminal block 100 seen as if the top layer of the block 100 had been removed and the internal of solid block viewed. Clearly seen in FIG. 1D are block 100, hole 112, and master rings 202, 204, 206. FIG. 1E is a front view of the terminal block 100 and shows tapered portions 102, as well as holes 106, 108, 110 in which the master rings 202, 204, 206 are positioned. Not seen in FIG. 1A through FIG. 1E are any of the threaded portions for purposes of clarity.

Figure 2:
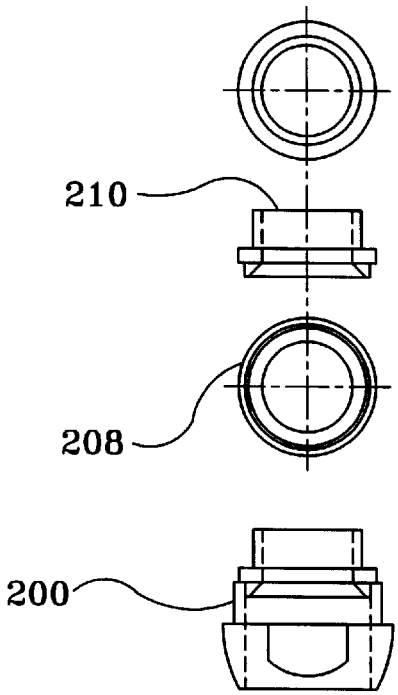
FIG. 2 are side and schematic views of the master ring and collet for a one gauge wire cable in accordance with the principles of the present invention.

FIG. 2 is a side sectional view of a master ring as seen in FIG. 1D. A typical master ring 200 assembly is seen as having a circular ring shape portion of a first diameter, and a second portion having a threaded portion with a hole provided therethrough to provide an opening for the wire power cable to extend through. FIG. 2 also shows a front view of a collet 208 having a first diameter which would be the width necessary to accommodate a 1 gauge wire power cable. FIG. 2 also shows the inner diameter 210 of the collet to accommodate the 1 gauge power cable.

Figure 3:
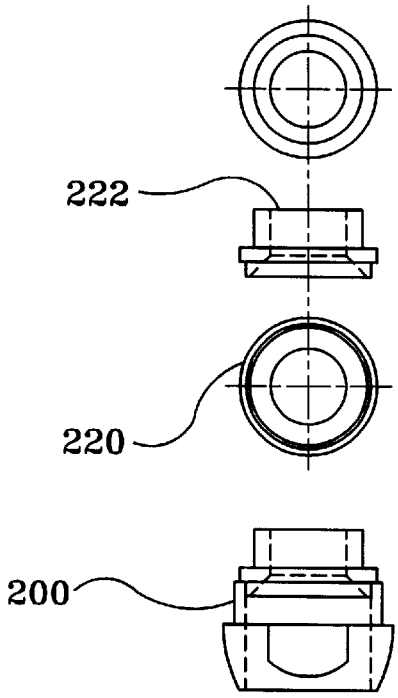
FIG. 3 are side and schematic views of the master ring and collet for a two gauge wire cable in accordance with the principles of the present invention.
Figure 4:
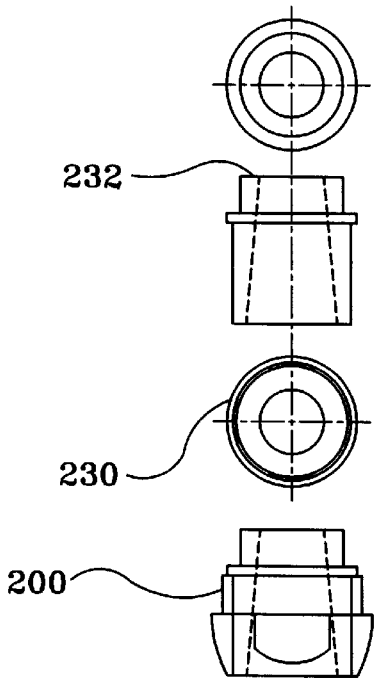
FIG. 4 are side and schematic views of the master ring and collet for a four gauge wire cable in accordance with the principles of the present invention.
Figure 5:
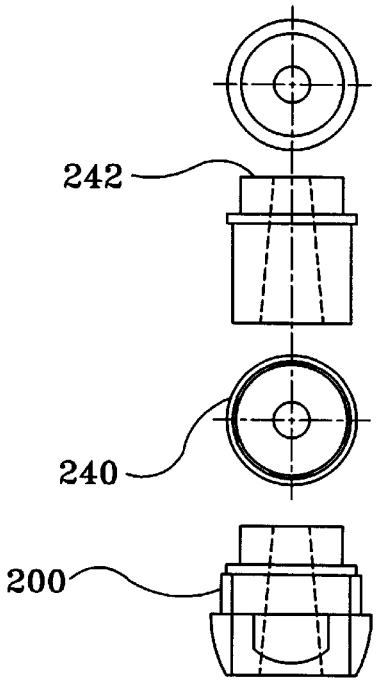
FIG. 5 are side and schematic views of the master ring and collet for an eight gauge wire cable in accordance with the principles of the present invention.

FIG. 3 shows the same master ring 200 with a collet 220 provided with a smaller diameter 222 to accommodate a 2 gauge power cable size. Both FIG. 2 and FIG. 3 show the collet 208 and collet 220 having first and second diameter portions, one of which fit inside the inside end of the master ring member, designated by the numeral 200, to form ring/collet assembly, also designated by the numeral 200, to accommodate the various size power cables. FIG. 4 shows the master ring assembly 200 along with its collet 230 which includes an even more narrow diameter 232 to allow for a 4 gauge wire to utilize the hole in the master ring. Similarly, FIG. 5 shows a master ring 200 with a collet 240 with even a narrower diameter hole 242 therethrough to accommodate the smaller gauge power cable. While FIGS. 2, 3, 4, 5 have been described in relation to 1 gauge, 2 gauge, 4 gauge, and 8 gauge wire cables, the collet and master ring assembly can be designed to accommodate any power gauge size for purposes of linking to a subsequent electronic device. As seen in FIGS. 2, 3, 4, and 5, master ring member 200 is the same master ring throughout, while the collet is changed for each integral assembly according to the size of the output power cable. Thus, connector block 100 can be utilized without substantive change regardless of the size of power cable to be connected to it via master rings 200.

Figure 7:
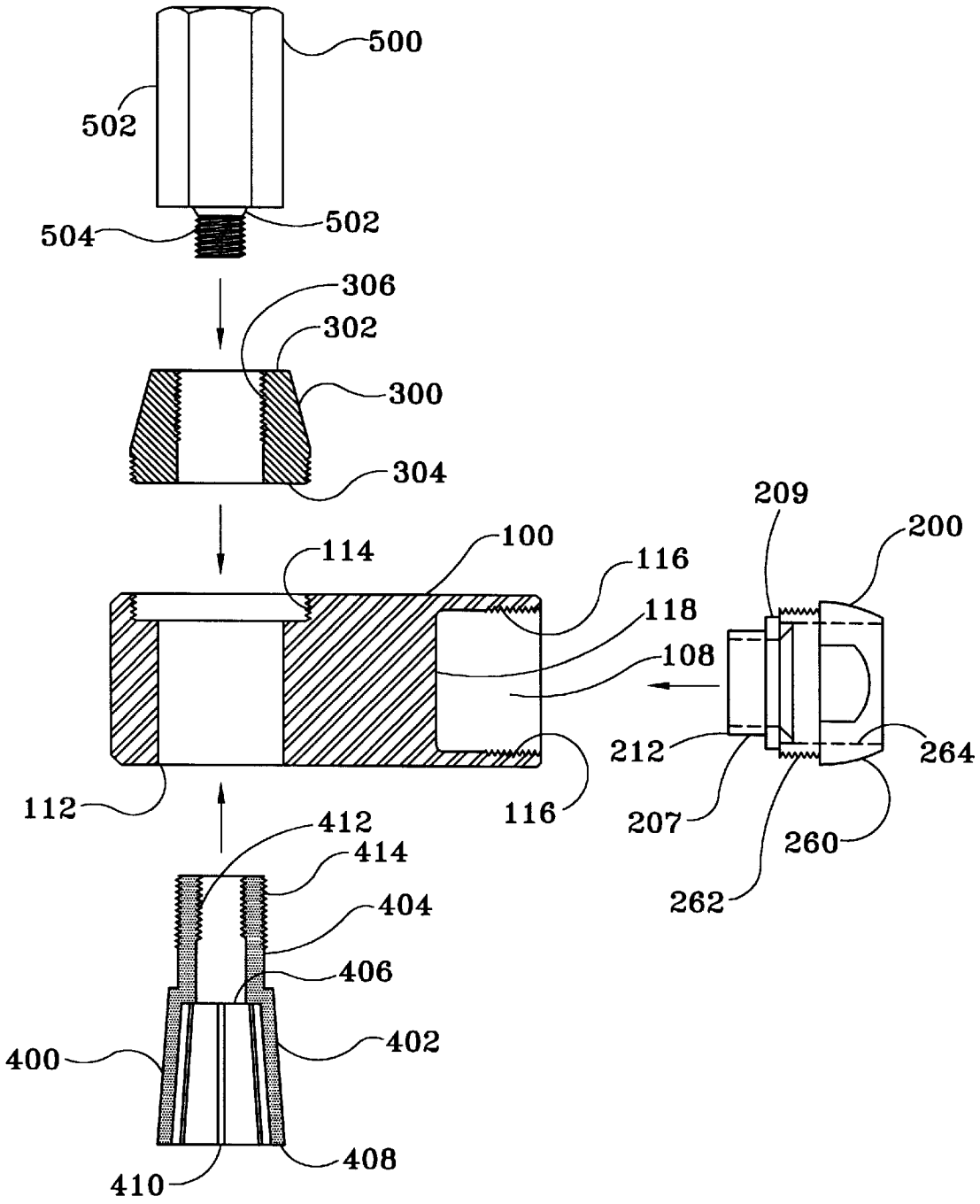
FIG. 7 is a cutaway view of the elements of the invention shown and described in conjunction with FIG. 6.

FIG. 7 is an exploded view of all the major parts of the connector block 100 seen in FIGS. 1 to 5 for the major parts, the master ring assembly 200, and associated typical collet 207, the battery clamp 400, a main terminal block 100, the master nut 300, as well as the charging post 500. The master ring member 200 includes a head portion 260 of a first diameter and a second threaded portion 262 of a second, smaller, diameter. The master ring member 200 also includes a longitudinal hole formed in the master ring to accommodate power cables of varying gauges in conjunction with collet 207 joined with master ring 200. The collets 208, 220, 230, and 240, seen in FIGS. 2 to 5, are of varying lengths and internal diameters. The external diameter of collet 207 is always the same so as to fit snugly within the internal diameter 264 of master ring 200. The internal collet diameter 210, 222, 232, or 242, as seen in earlier figures, is wider or narrower depending upon the gauge of the power cable to be connected to the terminal block 100. Also shown in FIG. 7 is the larger diameter collar 209 on the circumference of the collet 207 that is larger than the interior diameter 264 of master ring 200, so collet 207 will extend both internally of the master ring 200 and externally due to the collar 209 abutting the inner end of master ring 200.

The connector block 100 is shown in cross section in FIG. 7 and includes the hole 112, which extends all the way through the body of terminal block 100, and the concentric larger diameter hole 114 to accommodate the master nut 300, as will follow. Also shown in FIG. 7 on connector block 100 is internal threaded portion 116 to accommodate the external threads 262 of master ring 200. A power cable of varying size, depending upon which particular collet 207 (208, 220, 230, or 240) is connected to master ring 200, extends through the master ring 200 and collet 207 from right to left as seen in FIG. 7. At the inner end 212 of collet 207, the strands of (copper) wire, which are exposed from the end of a power cable and its insulating sleeve, are fanned out about the end of collet 207. master ring assembly 200 is then placed within the opening of, say, hole No. 2. The master ring 200 member with its threaded portion 262 mated with threaded portion 116 of block 100 is screwed in such that the end 212 of collet 207 forces the strands of wire to fan out about the end 212 of collet 207 and which are forced against the inner wall 118 of opening 108 in block 100. The outer head portion of master ring 200 may have opposite flattened edges, to accommodate a wrench, to be utilized to tighten the master ring in the hole 108 to maintain the tight relationship between the strands of wires of the power cable against the inner wall 118 of hole 108 in terminal block 100. The fact that the entire surface of the connector block 100 is gold plated improves the conductivity between the terminal block 100 and the wires strands comprising the power cable extending through the master ring member 200 and collet 207.

The battery clamp 400, which is the part that actually comes into contact with a post of a power source such as a post on a vehicle battery, is also shown in FIG. 7. Battery clamp 400 has two major portions seen FIG. 7. The first portion 402 is of an increasingly larger diameter extending out from the middle of the length of the battery clamp 400 and is comprised of the inner diameter 406 and increasingly expands to an outer diameter 408 to accommodate the tapered post of most vehicle batteries. In order to allow for a snug fit of the tapered end 402 of the battery clamp 400 on the battery post, the inner 406 to outer 408 dimension change of inner to outer diameters is closely matched to the actual taper of a battery post of a vehicle battery. However, to allow for a snug fit, the tapered portion 402 of battery clamp 400 includes longitudinal slits about the periphery of portion 402 to allow for expansion of the end of tapered portion 402 to accommodate the actual taper of a battery post. While twelve of these longitudinal slits are exemplary, any number of slits to accommodate and provide for a snug fit to the vehicle battery post may be utilized. Second portion 404 of the battery clamp 400 includes inner threads 412 which extend from the upper end partially into the upper portion of battery clamp 400. Also seen clearly in this figure as well, is the internal diameter of the lower portion tapered with an internal diameter extending from the tapered portion to the decrease in internal diameter of the second portion of the battery clamp 400 to allow for completing the assembly of the other parts as described below.

The inner threaded portion 412 of battery clamp 400 will mate with the threaded portion 504 of charging post 500, while the outer threaded portion 414 of upper section 404 of battery clamp 400 will mate with the threaded portion of master nut 300 in a manner that follows. After the battery clamp 400 is inserted up from the bottom of hole 112 in battery terminal block 100, the lower edge of the connector block 100 will be almost level and contiguous with the lower level of the battery clamp 400 and the lower edge of tapered portion 402. This allows for a firm seating of the terminal block 100 on the supplied battery clamp cable of the normal electrical system of modern-day motor vehicles.

Master nut 300 is also seen in FIG. 7. Master nut 300 is formed from one piece of metal, such as the same type of brass coated with 24 karat gold as that of terminal block 100. Master nut 300 would have an upper surface 302 and the lower surface 304. For aesthetic purposes the taper of the outer diameter is provided, but not seen are two parallel cutouts on both sides of the master nut to allow for hand tightening or with the use of a wrench to tighten the master nut to the battery clamp 400 when inserted and mated together in terminal block 100. Thus, battery clamp 400 would be inserted up through the hole 112 in terminal block 100, and then the master nut 300 would be placed over the end of upper portion 404 of battery clamp 400 and the external screw threads 414 of battery clamp 400 are mated to internal screw threads 306 of master nut 300. As the lower surface 304 of master nut 300 is of the same diameter as hole 114 on terminal block 100, the master nut 300 will fit into the circular slot formed in terminal block 100 as it is tightened against battery clamp 400.

The assembly of the battery terminal of the present invention is essentially complete at this point. The tapered portion of battery clamp 400 fits over the battery post provided on most vehicles with the terminal block 100 making electrical contact through the threaded portions and the tight proportions of the components, together with the electrical path between be tapered portion 402 of the terminal block 100 to the electrical wire strands abutting against inner wall 118 of hole 108. Master nut 300 would be snugly drawn and tightened against the circular slot 114 terminal block 100 thereby maintaining the tight relationship between master nut 300, terminal block 100, and battery clamp 400. The master ring 200 would be drawn into hole 108 to assure that the electrical connection of the wires in the power cable against back wall 118 of hole 108 is made, as well. The other two holes and master ring/collet assemblies would be similarly assembled for power cables leading to other electrical components within the vehicle itself. As set forth above, depending upon the size of power cable desired, the master ring 200 would be provided with separate collet pieces 207 to accommodate the various power cable gauges depending upon the amount of current to be drawn by the electrical components in the vehicle.

In certain instances, as when the vehicle battery falls below a certain electric potential, a separate charging system must be provided. External battery cables, well known in the art for many years, may be utilized to clamp on a battery terminal to provide electrical power from a separate generator, or adjacent battery from another vehicle. Charging post 500 would be utilized in this instance to provide a gripping surface for the battery cables leading to the extra generator or other vehicle battery. Charging post 500 has three separate portions. Upper portion 502 is shown in FIG. 7 to be an elongated octagonal shaped piece with the sides as machined or formed for gripping purposes. Of course, any number of sides could be formed for aesthetic purposes, or even could be knurled for gripping the clamps on a set of battery cables. The second portion 502 would be a smaller diameter leading to an even smaller diameter threaded portion 504. The threaded portion 504 will mate with the threaded portion 412 of battery clamp 400. When external power or charging is necessary, the charging post 500 would be screwed into the internal diameter of battery clamp 400, utilizing the threaded portion 412 of battery clamp 400 to provide the snug fit and electrical connection between the charging post 500 and the battery post of the vehicle battery, not seen in this figure. After the charging procedure has been completed, the charging post 500 would be unscrewed and removed for storage on or off the vehicle for later use, when and if necessary.

Figure 6:
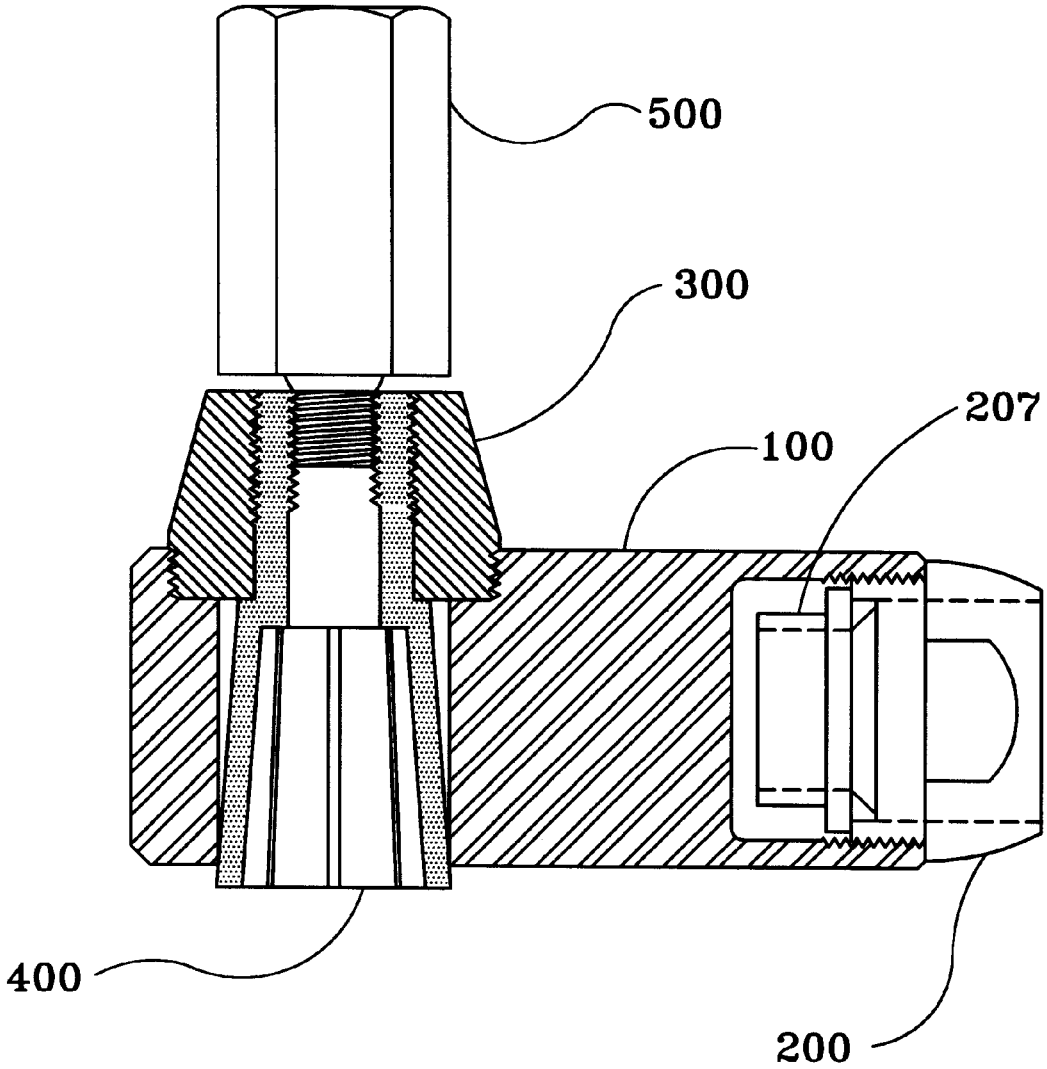
FIG. 6 is a side, partially schematic, view of the battery power block of the present invention.

FIG. 6 of the present application shows all of the components of FIG. 7 of the connector block as would be as installed on a vehicle. Thus, master ring 200 would be screwed into its accompanying portion of connector block 100 with the collet 207 providing the necessary diameter for a power cable to be connected to the terminal block 100. Battery clamp 400 is inserted into the bottom hole of terminal block 100 and coupled to master nut 300. Charging post 500 is shown screwed into the upper threaded portion of battery clamp 400 and abuts the top of both the master nut 300 and battery clamp 400.

Figure 8:
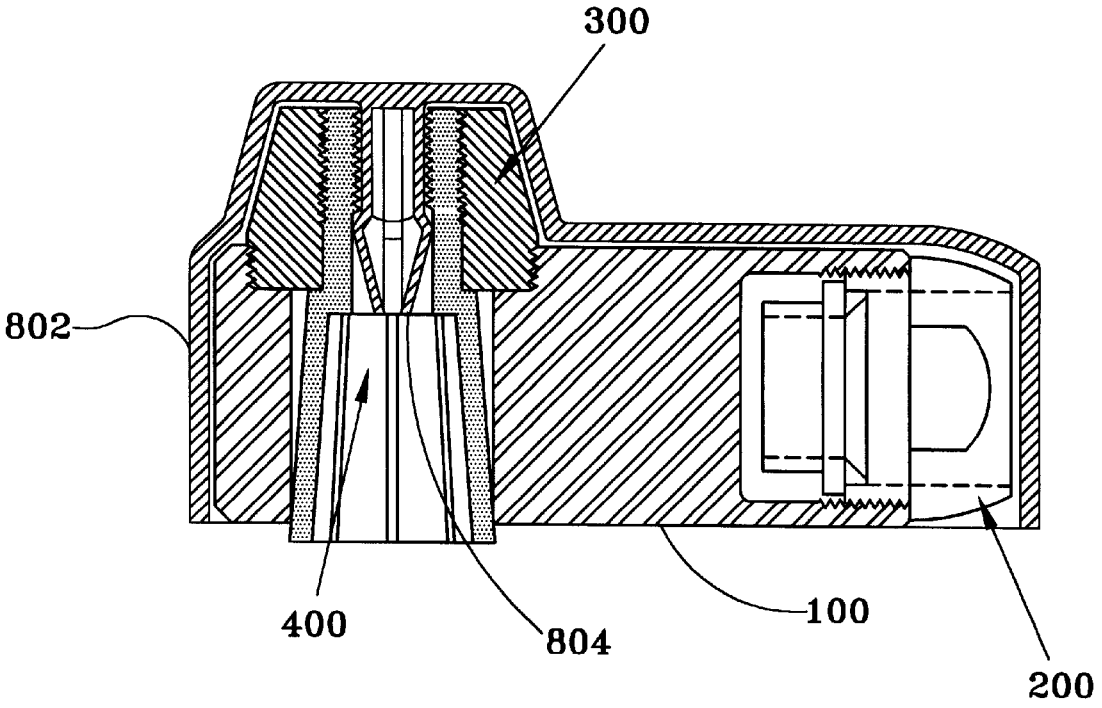
FIG. 8 is a view of another embodiment of the present invention.
Figure 7:
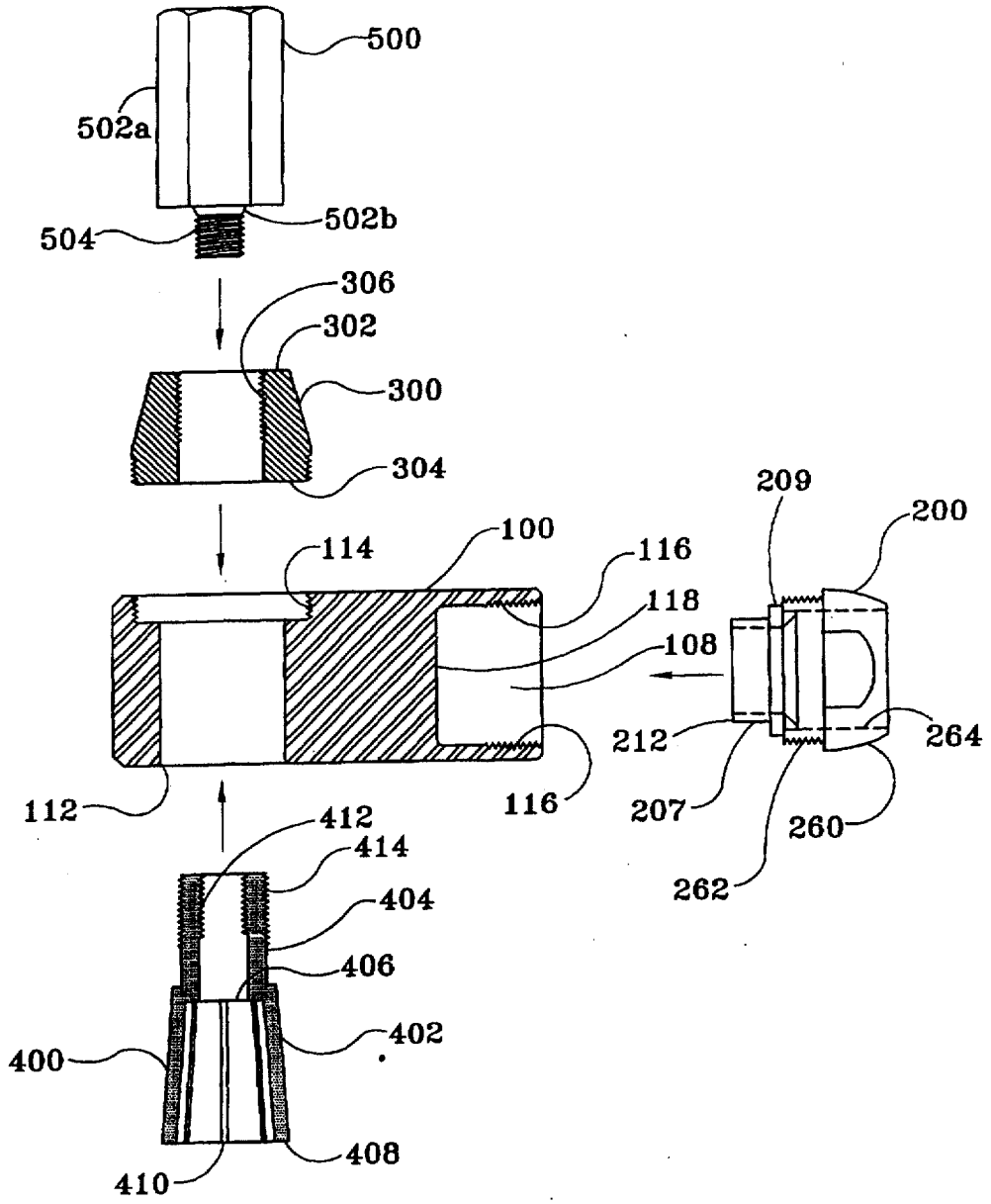

FIG. 8 is similar to that of FIG. 6, while FIG. 8 does not have a charging post connected to it, but does have a polycarbonate cover 802 which covers the connector block 100 to protect it from corrosive elements while installed on a vehicle. FIG. 8 also includes prongs 804 which are part of the cover 802 and are formed of uneven cylindrical surfaces so that when placed over the terminal block 100 with all of its parts assembled thereto, the polycarbonate cover 802 will snap into position as the uneven cylindrical surfaces of the prongs pass certain internal diameter changes of the upper inner portion of battery clamp 400. Thus, when a charging situation arises and use of the charging post 500 is necessary, the cover 802 will be removed and the charging post 500 screwed into the mated portion of battery clamp 400.

The invention has been described above with references to specific embodiments. It will be apparent to those skilled in the art that various modifications may be made and other embodiments can be used without departing from the broader scope of the invention. Therefore, these and other variations upon the specific embodiments are intended to be covered by the present invention, which is limited only by the appended claims.

What is claimed is:

1. An electrical connector block assembly for distributing electric power from a power source to wire conductors, comprising:

a conductive base unit having a top and bottom surface,
- said conductive base unit further having a first opening in said top surface of said base unit extending through to said bottom surface,
- said base unit being a geometrically shaped base unit having at least one shape feature selected from a group of shape features consisting essentially of a triangle, a fan, and a clover-leaf,
  - wherein a fan-shaped unit comprises a vertex and extended portions radiating from the vertex, said first opening in said base unit being formed essentially at the vertex of said base unit, at least one master ring assembly for attachment to at least one of said extended portions of said base unit, said master ring assembly being utilized to attach a wire conductor to said base unit,
- wherein said at least one master ring assembly comprises:
  - a master ring comprising a tubular head member with a first portion having a first external dimension and a second portion having a second external dimension, said second portion having a threaded portion, and including a longitudinal axial opening through said master ring of a master ring inner dimension, said first portion of said master ring tubular head member being adapted for manual or physical tightening movements thereon; and
  - a collet portion comprising a tubular member with at least a first and a second outer dimension wherein said first dimension is approximately the same as the master ring inner dimension and said second dimension being of a dimension conducive to positioning within one of said extended portions of said conductive base, said collet portion including a longitudinal opening along an axis thereof to match that of a conductive wire cable to be connected to said electrical connector block.

2. The electrical connector block assembly of claim 1, wherein said master ring tubular head member is circular wherein said threaded portion is externally disposed, and wherein said collet portion tubular member is circular.

3. The electrical connector block assembly of claim 2 wherein the extended portion of said conductive base unit comprises circular, radial openings extending into the base unit, said openings including inner threads which extend at least partially along said circular, radial openings, said inner threads of said circular radial openings receiving in operative screw relationship with the external threaded portions of at least one said master ring.

4. The electrical connector block assembly of claim 3 wherein at least one master ring assembly is placed in one of said circular openings in the extended portion of said conductive base unit, wherein the collet portion includes a longitudinal opening along the axis thereof to substantially match the gauge of a wire connector coupled thereto.

5. The electrical connector block assembly of claim 4 wherein each of said components of said connector block assembly is made of brass.

6. The electrical connector block assembly of claim 5 wherein each brass component is plated with gold.

7. The electrical connector block assembly of claim 1 further comprising an insulating housing surrounding said conductive base unit.

8. The electrical connector block assembly of claim 1 wherein said assembly further comprises:

a battery clamp portion being positioned in said conductive base unit through the first opening in said base unit, said battery clamp portion being positioned from the bottom surface of said base unit and extending out past the top surface of said base unit; and a master nut for attachment to the portion of said battery clamp portion to draw the lower portion of said battery clamp into the body of said base unit to maximize the contact of said pattern clamp lower portion first opening in said base unit, wherein said battery clamp portion comprises a first portion including a tubular portion extending out longitudinally from the middle of the length of said battery clamp and comprising an inner diameter which increasingly expands to an outer diameter along the axis of said battery clamp to accommodate the tapered post of a vehicle battery, said battery clamp also including a second portion extending longitudinally along said longitudinal axis of said battery clamp and which includes inner threads which extend from the upper end partially into the upper portion of said battery clamp, and an outer threaded portion along the outer surface of said battery clamp, wherein said master nut comprises a tubular portion of a first diameter and a longitudinal axial opening through and defining said tubular portion, said tubular portion including inner threads which extend at least partially through said longitudinal axial opening.

9. The electrical connector block assembly of claim 8 wherein said conductive base unit includes a second opening coaxially with said first opening in the top surface of said conductive base unit, said second opening extending only partially into said base unit, and having a larger diameter than said first opening, said master nut having at least one end of said tubular portion approximately the same diameter of said second opening of said conductive base unit to accommodate the positioning of said master nut in the second opening of said conductive base unit, and wherein the inner threads of said master nut receive in operative screw relationship the outer threaded portion on the outer surface of said battery clamp.

10. The electrical connector block assembly of claim 9 wherein said battery clamp portion is introduced into said first opening in said conductive base unit from the bottom surface toward the top surface thereof, said master nut being placed in operative screw relationship with said outer threads of said battery clamp portion such that as said master nut is tightened on said battery clamp portion, the first portion of said battery clamp portion is moved into intimate relationship with the surface of said first opening of said conductive base unit.

11. The electrical connector block assembly of claim 9 further including a charging post comprising an elongated portion comprising a first section of a first general diameter and a second coaxial section of a second smaller diameter, said second section extending longitudinally away from said first section, said second section including outer threads at least partially along the longitudinal outer surface of said second section, said outer threads of said second section of said charging post extending in operative relationship with said inner threads of said battery clamp portion.

12. The electrical connector block assembly of claim 11 wherein each of said components of said connector block assembly is made of brass.

13. The electrical connector block assembly of claim 12 wherein each brass component is plated with gold.

14. An electrical connector block assembly for distributing electric power from a battery to wire conductors, comprising:

a conductive base unit having a top and bottom surface, said conductive base unit further having a first opening in said top surface of said base unit extending through to said bottom surface, said base unit having at least one shape feature selected from a group of shape features consisting essentially of a triangle a fan, and a clover-leaf with a vertex and extended portions radiating from the vertex, said first opening in said base unit being formed essentially at the vertex of said base unit, a battery clamp portion being positioned in said conductive base unit through the first opening in said base unit, said battery lamp portion being positioned from the bottom surface of said base unit and extending out past the top surface of said base unit, at least one master ring assembly for attachment to at least one of said extended portions of said base unit, said master ring assembly being utilized to attach a wire conductor to said base unit, and a master nut for attachment to the portion of said battery clamp portion to draw the lower portion of said battery clamp into the body of said base unit to maximize the contact of said pattern clamp lower portion first opening in said base unit, wherein, said battery clamp portion comprises a first portion including a tubular portion extending out longitudinally from the middle of the length of said battery clamp and comprising an inner diameter which increasingly expands to an outer diameter along the axis of said battery clamp to accommodate the tapered post of a vehicle battery, said battery clamp also including a second portion extending longitudinally along said longitudinal axis of said battery clamp and which includes inner threads which extend from the upper end partially into the upper portion of said battery clamp, and an outer threaded portion along the outer surface of said battery clamp.

15. The electrical connector block assembly of claim 14 wherein said master nut comprises a tubular portion of a first diameter and a longitudinal axial opening through and defining said tubular portion, said tubular portion including inner threads which extend at least partially through said longitudinal axial opening.

16. The electrical connector block assembly of claim 15 wherein said conductive base unit includes a second opening coaxially with said first opening in the top surface of said conductive base unit, said second opening extending only partially into said base unit, and having a larger diameter than said first opening, said master nut having at least one end of said tubular portion approximately the same diameter of said second opening of said conductive base unit to accommodate the positioning of said master nut in the second opening of said conductive base unit, and wherein the inner threads of said master nut receive in operative screw relationship the outer threaded portion on the outer surface of said battery clamp.

17. The electrical connector block assembly of claim 16 wherein said battery clamp portion is introduced into said first opening in said conductive base unit from the bottom surface toward the top surface thereof, said master nut being placed in operative screw relationship with said outer threads of said battery clamp portion such that as said master nut is tightened on said battery clamp portion, the first portion of said battery clamp portion is moved into intimate relationship with the surface of said first opening of said conductive base unit.

18. The electrical connector block assembly of claim 16 further including a charging post comprising an elongated portion comprising a first section of a first general diameter and a second coaxial section of a second smaller diameter, said second section extending longitudinally away from said first section, said second section including outer threads at least partially along the longitudinal outer surface of said second section, said outer threads of said second section of said charging post extending in operative relationship with said inner threads of said battery clamp portion.

19. The electrical connector block assembly of claim 18 wherein each of said components of said connector block assembly is made of brass.

20. The electrical connector block assembly of claim 19 wherein each brass component is plated with gold.

* * * * *

UNITED STATES PATENT AND TRADEMARK OFFICE

CERTIFICATE OF CORRECTION

PATENT NO. : 6,227,914 B1
DATED : May 8, 2001
INVENTOR(S) : Kendrew Lee and Demian Martin It is certified that error appears in the above-identified patent and that said Letters Patent is hereby corrected as shown below:

Title page,
The title page showing the illustrative figure should be deleted and substituted with the attached.
Drawing corresponding to Figure 7, upper portion 502: add -- a --;
Drawing corresponding to Figure 7, second portion 502: add -- b --;

Drawings,
Figure 7, upper portion 502: add -- a --;
Figure 7, second portion 502: add -- b --;

Column 7,
Line 39, after 502 add -- a --;
Line 44, after 502 add -- b --;

Signed and Sealed this

Twenty-eighth Day of May, 2002

*Attest:*

*Attesting Officer*

JAMES E. ROGAN
*Director of the United States Patent and Trademark Office*

(12) United States Patent
Lee et al.

(10) Patent No.: US 6,227,914 B1
(45) Date of Patent: May 8, 2001

(54) POWER DISTRIBUTION BLOCK ASSEMBLY FOR ACCOMMODATING MULTIPLE GAUGE WIRES

(75) Inventors: Kendrew Lee, San Jose; Demian Martin, Pacifica, both of CA (US)

(73) Assignee: Monster Cable Products, Inc., Brisbane, CA (US)

( * ) Notice: Subject to any disclaimer, the term of this patent is extended or adjusted under 35 U.S.C. 154(b) by 0 days.

(21) Appl. No.: 09/327,047

(22) Filed: Jun. 7, 1999

(51) Int. Cl.[7] ..... H01R 4/28

(52) U.S. Cl. ..... 439/754; 439/766; 439/805; 439/957

(58) Field of Search ..... 439/754, 724, 439/798, 431, 416, 766

(56) References Cited

U.S. PATENT DOCUMENTS

| | | | | |
|---|---|---|---|---|
| 4,380,291 | * | 4/1983 | Shannon | 439/754 |
| 4,405,196 | * | 9/1983 | Fulton | 439/754 |
| 4,747,793 | * | 5/1988 | Fakula et al. | 439/766 |
| 5,266,057 | | 11/1993 | Angel, Jr. et al. . | |

* cited by examiner

*Primary Examiner*—Neil Abrams
*Assistant Examiner*—J. F. Duverne

(74) *Attorney, Agent, or Firm*—Lariviere, Grubman & Payne, LLP

(57) ABSTRACT

A solid brass battery connector block assembly for providing power distribution from a power source, such as a vehicle battery, to attached wire conductors. The assembly includes a conductive base unit 100 which connects to a battery via a battery clamp portion 400. The battery clamp portion 402 is mounted in an opening 112 in the base unit 100 that extends from the top surface to the bottom surface thereof. The base unit 100 is essentially fan shaped and is molded with extended portions emanating from the vertex of the fan shape. At the ends of the extended portions are molded or machined holes 106, 108, 110 extending into the body of the base unit 100. Master rings 202, 204, 206 and collet assemblies 208, 220, 230, or 240 are screw mounted in the holes 106, 108, 110 in the extended portions, the collets 208, 220, 230, or 240 having varying central bore holes to accommodate various gauge size wire conductors. A master nut 300 is mounted on the base unit 100 from the top thereof onto the battery clamp portion 402 extending up through the opening from the bottom of the base unit 100. As the master nut 300 is tightened on the battery clamp portion 402, the battery clamp 400 is tightened against the terminal of the vehicle battery and also the inside of the opening 112 in the base unit 100 to provide an excellent conductive path for the electric current to flow from the battery to the wire conductors. A charging post 500 is also provided to attach in a screw relationship to the battery clamp portion 404 in the event the battery needs external charging

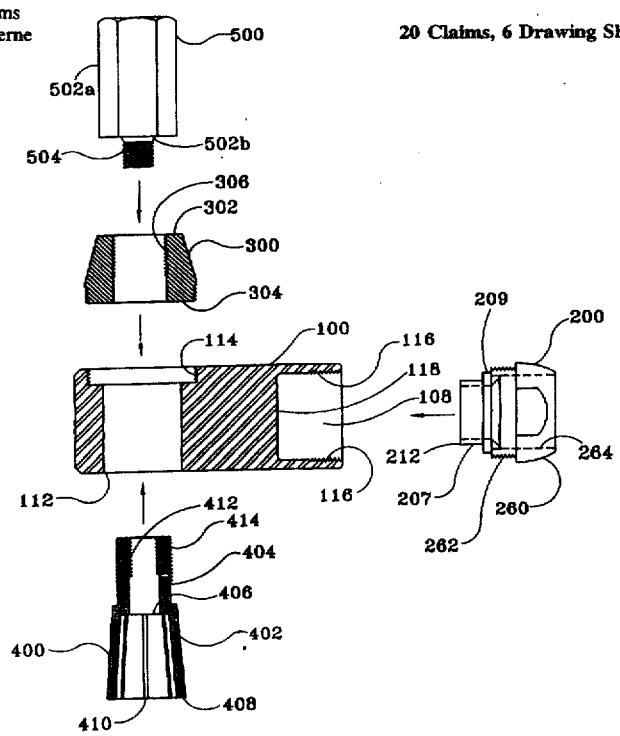

20 Claims, 6 Drawing Sheets